US006895982B1

(12) United States Patent
Shaw

(10) Patent No.: US 6,895,982 B1
(45) Date of Patent: May 24, 2005

(54) CARRIABLE STORAGE BUCKET FOR SUPPORTING A RAISED UMBRELLA

(76) Inventor: Michael Alan Shaw, 1337 Rockledge Dr., Rockledge, FL (US) 32955

( * ) Notice: Subject to any disclaimer, the term of this patent is extended or adjusted under 35 U.S.C. 154(b) by 73 days.

(21) Appl. No.: 10/328,595

(22) Filed: Dec. 23, 2002

(51) Int. Cl.[7] ..... A45B 3/00; B62B 3/02

(52) U.S. Cl. ..... 135/16; 248/519; 248/523; 206/216

(58) Field of Search ..... 135/16; 248/519, 248/529, 530, 346.03, 346.2, 910; 206/216; 220/592.03; 62/331, 457.7

(56) References Cited

U.S. PATENT DOCUMENTS

| | | | | | |
|---|---|---|---|---|---|
| 3,216,681 | A | * | 11/1965 | Paolo | 248/529 |
| 4,148,455 | A | * | 4/1979 | Oliver | 248/524 |
| 4,296,693 | A | * | 10/1981 | Archer | 108/28 |
| 4,832,163 | A | * | 5/1989 | Levesque | 190/11 |
| 5,143,108 | A | | 9/1992 | Kenney | 135/16 |
| 5,169,111 | A | * | 12/1992 | Dunaj | 248/523 |
| 5,207,406 | A | * | 5/1993 | Stine et al. | 248/514 |
| 5,269,157 | A | * | 12/1993 | Ciminelli et al. | 62/457.7 |
| 5,271,196 | A | * | 12/1993 | Fanti | 52/166 |
| 5,427,346 | A | * | 6/1995 | Urgola | 248/519 |
| 5,433,551 | A | | 7/1995 | Gordon | 403/377 |
| 5,482,245 | A | * | 1/1996 | Graves | 248/523 |
| 5,636,944 | A | | 6/1997 | Buttimore | 405/244 |
| 5,823,213 | A | * | 10/1998 | Patarra | 135/16 |
| 5,967,359 | A | | 10/1999 | Mindell | 220/475 |
| 6,105,300 | A | | 8/2000 | Abdo | 43/17 |
| 6,199,570 | B1 | * | 3/2001 | Patarra | 135/16 |
| 6,199,818 | B1 | * | 3/2001 | Tsappi | 248/519 |
| 6,371,432 | B1 | * | 4/2002 | Tsappi | 248/523 |
| 6,446,649 | B1 | * | 9/2002 | Bigford | 135/16 |
| 6,554,012 | B2 | * | 4/2003 | Patarra | 135/16 |
| 2001/0006073 | A1 | * | 7/2001 | Patarra | 135/16 |
| 2001/0013358 | A1 | * | 8/2001 | Patarra | 135/16 |
| 2001/0054433 | A1 | * | 12/2001 | Patarra | 135/16 |
| 2002/0028716 | A1 | | 3/2002 | Gormley | 473/423 |
| 2003/0094189 | A1 | * | 5/2003 | Ko | 135/16 |

FOREIGN PATENT DOCUMENTS

| | | | |
|---|---|---|---|
| FR | 2678977 | * | 1/1993 |

* cited by examiner

*Primary Examiner*—Robert Canfield
(74) *Attorney, Agent, or Firm*—Brian S. Steinberger; Law Offices of Brian S. Steinberger, P.A.

(57) ABSTRACT

Carrying bucket that can be converted to a support stand for an umbrella. A 5 and ½ gallon bucket having a rotatable handle can be used to carry supplies such as towels, food and beverages from one remote location such as an automobile parking lot to a beach location. At the beach location, the bucket is placed on a ground surface where an umbrella stand can be attached to the bucket so that the bucket functions as an above ground ballast anchor to support the umbrella in an upright position.

19 Claims, 5 Drawing Sheets

CARRIABLE STORAGE BUCKET FOR SUPPORTING A RAISED UMBRELLA

This invention relates to umbrellas and storage containers, in particular to a novel bucket apparatus that can be used to carry and store items therein, and be used as a base anchor positioned on a ground surface for supporting an umbrella in an upright position.

BACKGROUND AND PRIOR ART

Various devices have been proposed over the years for mounting umbrellas on beaches. Many of these devices are generally limited to inserting the lower end of an umbrella stand into the sand where the lower end has either or both a sharp point and/or a screw type configuration. Problems arise with mounting these devices since the user must mechanically press the umbrella stand into the ground a substantial distance in order to have proper stability to keep the umbrella in an upright position. This installation technique is further compounded when the sand surface is hard such that the ground surface does not allow for easy insertion.

Still furthermore, typical beach goers usually carry more than an umbrella to the beach. For example, towels, coolers, and the like are common items that must also be carried. One person usually has great difficulty carrying their umbrella, and loosely carrying their towels and other usual supplies, such as beverages and food.

Over the years various types of devices have been proposed but fail to adequately solve all the problems with the typical approach of most beach goers.

U.S. Pat. No. 5,636,944 to Buttimore describes an "anchor for a beach umbrella", title, that requires an upside down bell type shaped bucket that must be both buried and filled in order to be used an anchor for a beach umbrella. Besides the difficulties that would be encountered with having to dig out an opening in the ground for this "anchor", this device cannot be used to carry objects in when not being used as an anchor.

U.S. Pat. No. 5,967,359 to Mindell describes a "receptacle", title, that can be used with an umbrella FIG. 3. However, this device cannot be used as a base stand for the umbrella and cannot be used to adequately hold and carry supplies when not being used.

U.S. Pat. No. 5,143,108 to Kenney describes a "beach umbrella", title, describes an elaborate storage stand that can be used with a beach umbrella. However, this apparatus requires that the lower bottom end of the umbrella stand include a sharpened type end for penetrating into a ground surface for anchoring the umbrella. Furthermore the elaborate storage stand cannot be easily used as a portable holder to carry items when not being used with the umbrella.

Other patents such as but not limited to U.S. Pat. No. 6,105,300 to Abdo and U.S. Publication 2002/0028716A1 to Gormley also fail to adequately solve the problems presented above.

SUMMARY OF THE INVENTION

The first objective of the present invention is to provide a device that can be used as a portable holder to carry supplies and used as a mounting base for an umbrella stand.

The second objective of the present invention is to provide a device that can be converted from a portable carrying bucket to a mounting base for an umbrella stand.

The third objective of the present invention is to provide an umbrella stand that does not require a bottom end of the stand to be inserted and/or buried under the ground.

The fourth objective of this invention is to provide a portable bucket that can be used as an umbrella stand.

Novel apparatus and method of converting buckets from being used to carry items to being support anchors for umbrellas. Novel steps and components can include carrying a bucket containing at least one loose item such as but not limited to food, beverages, towels, and the like, from one location to another, with a rotatable handle. The bucket can include insulative materials for allowing perishable items to be stored inside, and a removable lid. A T-shaped support member can be attached inside of the bucket. Alternatively, the T-shaped support member can be pre-attached inside of the bucket. An umbrella stand can be attached to a portion of the support member within the bucket, and the bucket support the umbrella in an upright position on a ground surface without having to bury the bucket in the ground.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangement shown since the invention is capable of other embodiments. Also, the terminology used herein is for the purpose of description and not of limitation.

Figure 1:
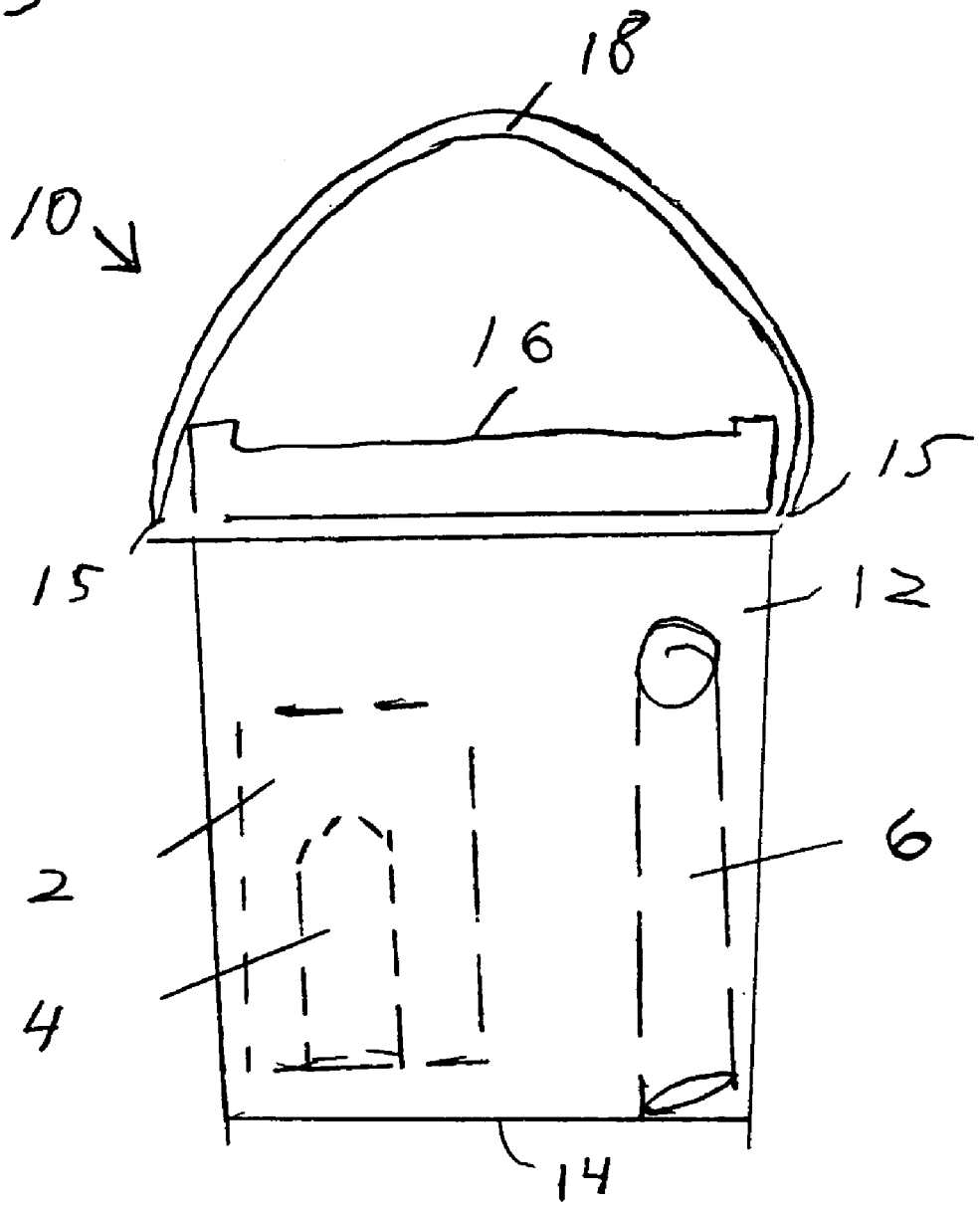
FIG. 1 shows a side view of a novel bucket for use with the subject invention.

FIG. 1 shows a side view of a novel bucket 10 for use with the subject invention which can be an approximately 5 and ½ gallon plastic cylindrical type bucket, with side walls 12 having a height of approximately 15 and ⅜ inches which taper down from a large open end 16 to a substantially closed bottom floor 14. A rotatable U-shaped type handle 18 can be rotatable attached to the bucket by swivel type connectors 15. With the handle in an upright position, various items such as beach supplies including but not limited to food 2, beverage(s) 4, towel(s) 6, and the like, can be stored inside. The novel bucket 10 can be used to carry various items from a remote location such as but not limited to a parking lot, to another location such as but not limited to a beach setting.

Figure 2:
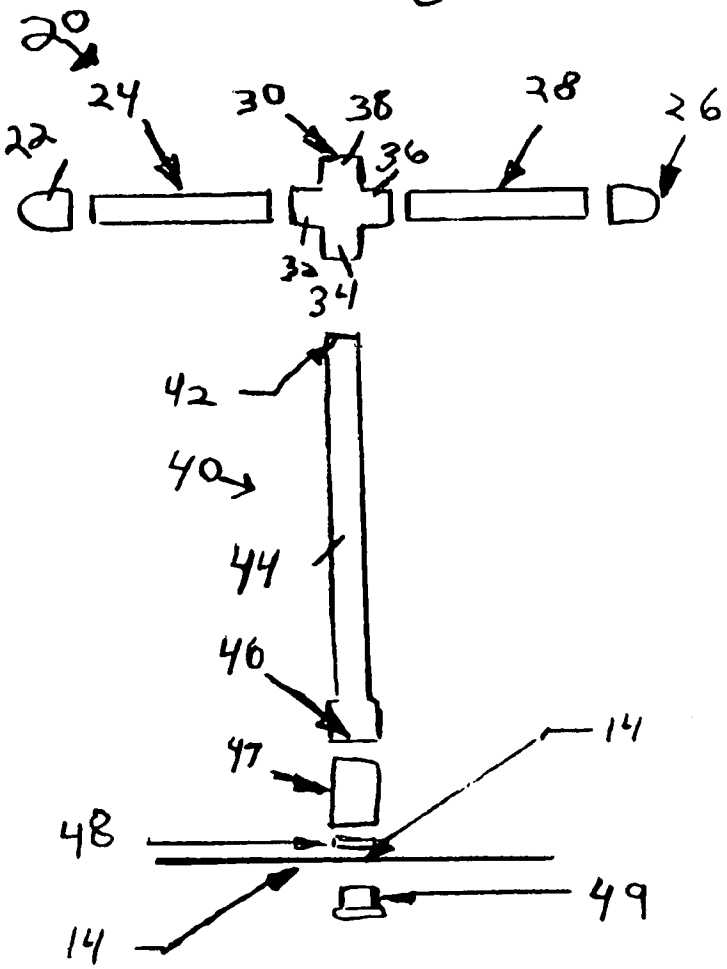
FIG. 2 shows an exploded view of an umbrella shaped support member used within the bucket of FIG. 1.

FIG. 2 shows an exploded view of an umbrella shaped support member 20 used within the bucket of FIG. 1. The support member 20 can be of a substantially T-shaped configuration and include two arm portions 24, 28 that can be approximately ¾ inch PVC pipes having outer ends insertable into rounded exterior surface plastic end caps 22, 26, such as approximately ¾ inch schedule 40 slip end caps with approximately 3/16 inch holes in their centers. Inner ends of the two arm portions 24, 28 can telescopingly be inserted into opposing hollow prongs 32, 36 of a cross shaped connector 30, such as an approximately ¾ inch cross schedule 40 PVC connector. The cross connector 30 can include prongs that are perpendicular to one another. A lower downwardly projecting hollow prong 34 can receive the upper end 42 of a vertical leg member 40 such as an approximately 11 and ½ inch long PVC pipe having an approximately ¾ inch diameter. The lower expanded end 46 of the leg member 40 having an approximately 1⅛ inch threaded opening can be threadably attached to a threaded connector 47 such as an approximately ½ inch threaded coupling. A lower cap member 49 such as a threaded male adapter with an approximately 1 and ⅛ inch hex head can be threadably attached to a lower end of the threaded connector 47, along with a washer 48 such as an approximately 13/16 inch by approximately ⅝ inch by approximately 3/32 inch number 12 rubber O-ring wrapped about the cap 49.

Figure 3:
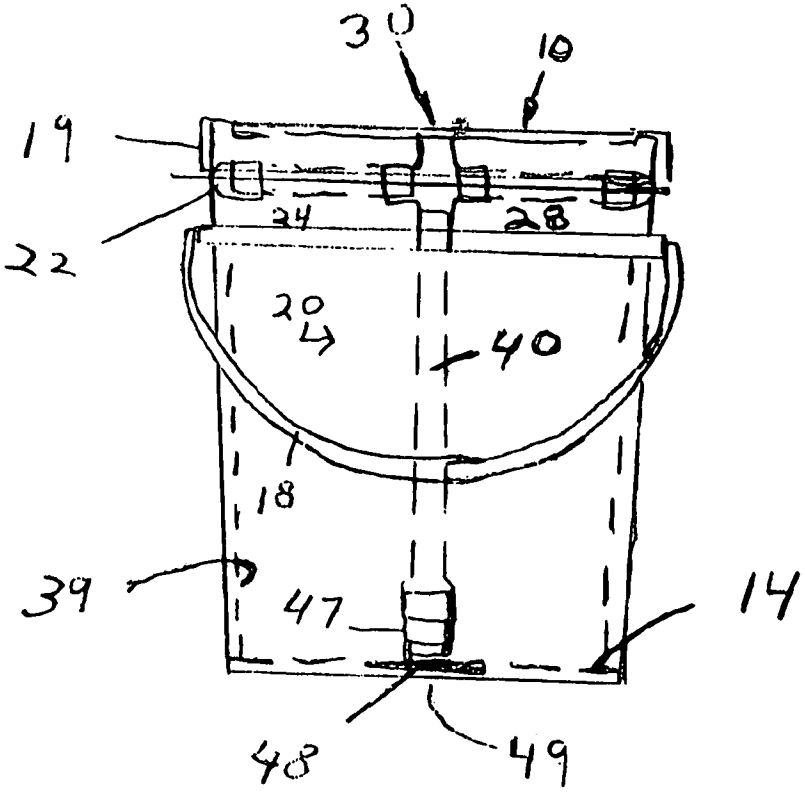
FIG. 3 shows a side view of the bucket of FIG. 1 with the support member inside.

FIG. 3 shows a side view of the bucket 10 of FIG. 1 with the support member 20 inside the bucket 10. The cap 49 can pass through a center opening portion of the floor 14 of the bucket 10 and be sealed in place by the washer 48. The cross connector 30 connects the arms 24, 28 to the vertical leg member 40, and the end caps 22, 24 can abut against inner walls of the side 12 of the bucket 10. The invention can be manufactured and/or sold and/or used with the combination of the arms 24, 28, with caped ends 22, 26 pre-attached to the vertical leg 40 by the connector 30 with pre-attached coupler 47 already locked in place within the bucket 10. Alternatively, users can use the bucket 10 without the T-shaped components 24, 28, 40, 47, and when ready, these components can together be inserted into the bucket 10 and screwed into place by being rotating about threaded upper end of the cap 49 which protrudes into the bottom of the bucket 10.

The washer 48 allows the bucket with support member 20 to have a waterproof interior compartment which can also hold wet objects such as ice, and the like, without spilling outside of the bucket 10. Optional insulative materials 39 such as foam, and the like, can also be used inside of the bucket 10, so that the bucket 10 can be used as an insulative type cooler for storing perishable items such as but not limited to food and beverages, inside of the bucket 10, and maintaining adequate storage temperatures of stored food and/or beverage items. A removable lid 19 can be snapped on or threadaby attached over, or a combination thereof over the top of the bucket to further cover or seal the open end 16 of the bucket 10. The lid 19 can have a center located through-hole for the pole 50 to be described below.

The combination of the member 40 and cross arms 24, 28 with or without the closed lid 19 creates an obstruction which functions as a safety feature inside the bucket 10 which would restrict children, pets, and the like, from falling into the bucket 10.

Figure 4A:
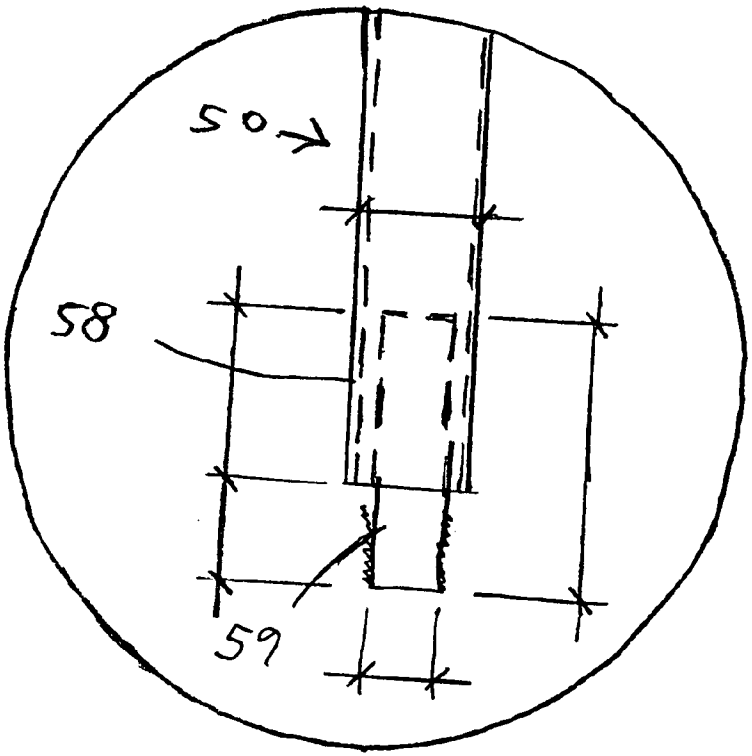
FIG. 4A shows an enlarged section of the pole of FIG. 4.
Figure 4:
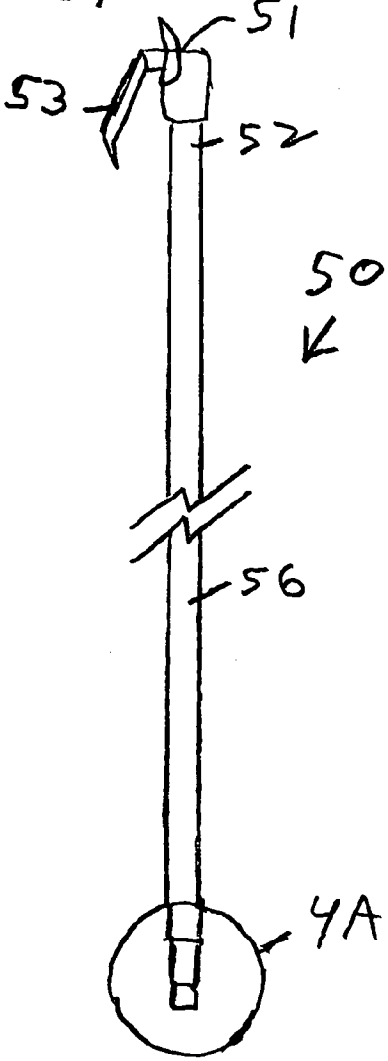
FIG. 4 shows a support pole for use with the support member and bucket of the preceding figures.

FIG. 4 shows a support pole 50 for use with the support member 20 and bucket 10 of the preceding figures. The pole 50 can be approximately 1 to approximately 3 feet long PVC type pipe with an outer diameter of approximately ⅞ of an inch and a hollow inner diameter of approximately ¾ of an inch. Pole 50 can include an upper end 52 having a rotatable lever portion 53 which can rotate downward to reduce an upper opening space 51 in the top of the pole 50. FIG. 4A shows an enlarged section of the pole stand 50 of FIG. 4, wherein a threaded surface coupler 59 such as an approximately 2 inch long by and approximately ½ inch diameter PVC coupling can be telescopingly received with the lower hollow end 58 of the pole 50. A lower end of the threaded coupler 59 can be telescopingly connected into the hollow upper prong end 38(FIGS. 2–3) of the cross coupler 30.

Figure 5:
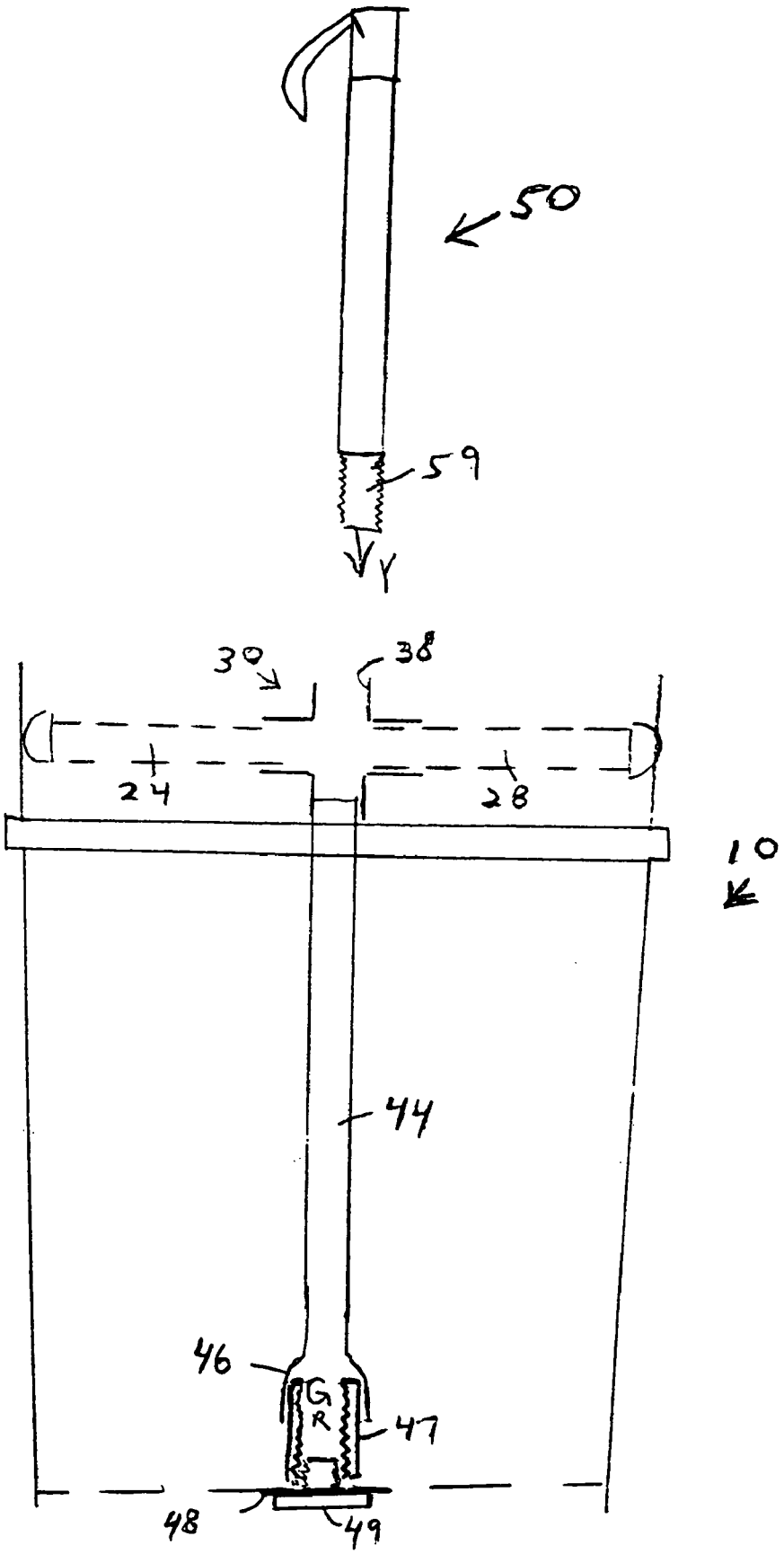
FIG. 5 shows the support pole of FIGS. 4, 4A being inserted into the support member within the bucket of FIGS. 2–3.

FIG. 5 shows the support pole 50 of FIGS. 4, 4A being inserted into the support member 20 within the bucket of FIGS. 2–3. Threaded coupler 59 can be inserted into hollow upper prong end 38, and passed through hollow member 44 and be rotated in the direction of arrow R within interior threaded walls of coupler 47 which locks the pole 50 in place.

Figure 6:
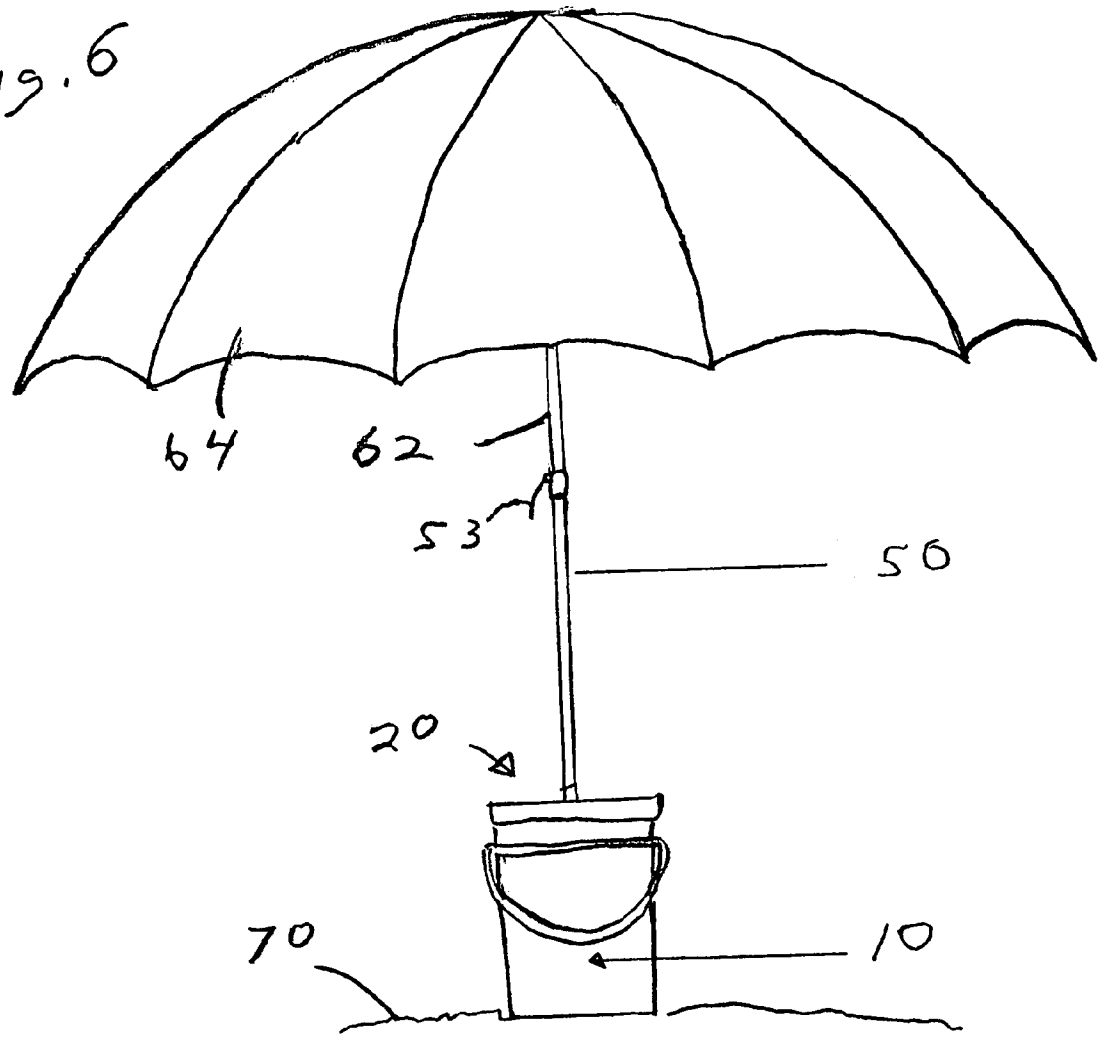
FIG. 6 shows an umbrella being supported and anchored by the bucket and pole of the preceding figures.

FIG. 6 shows an umbrella 64 with its stand 62 telescopingly inserted into pole 50 to a selected position, and locked in place by lever 53 being supported and anchored by the bucket 10 and stand of the preceding figures. The bucket 10 can be filled with ballast such as the items stored inside that were previously described. Alternatively, the bucket can be filled with other types of ballast such as but not limited to water, ice, sand, rocks, and the like. The novel invention allows for the bucket 10 to support the umbrella 64 in an upright position by merely placing the bucket 10 on a ground surface 70.

Although the preferred embodiment describes using the novel carrying bucket for supporting an umbrella stand, the novel invention can be used to support other upright stands such as those used for flags, bad mitten poles, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A device for both carrying supplies and being used as a support stand, comprising:

a bucket having a bottom floor portion, being positioned above a ground surface, and an upper opening;

a support member attached to an inside bottom floor portion inside of the bucket, and extending solely upward from the bottom floor portion;

an umbrella attached to the support member, wherein the bucket supports the umbrella in an upright position, wherein the bucket carries items therein with or without the attached umbrella;

a rotatable lid for threadably covering the upper opening of the bucket; and a vertical leg member telescopingly connecting the support member in the bucket.

2. The device of claim 1, further comprising:

a rotatable handle attached to the bucket.

3. The device of claim 1, wherein the support member and vertical leg member substantially form a T-shaped configuration having upper arm members adjacent to the upper opening of the bucket for engaging inner side walls of the bucket the vertical leg member extending downward from the upper arm members, the vertical leg member connected to the inside bottom floor portion of the bucket.

4. The device of claim 3, further comprising:

a portion for threadably connecting the vertical leg member to the inside bottom floor portion of the bucket.

5. The device of claim 3, further comprising:

a three prong connector, with each prong perpendicular to one another, for connecting the upper arm members and the vertical leg member together to form the substantially T-shaped configuration.

6. The device of claim 5, wherein the three prong connector includes an upper surface portion for telescoping connecting to a portion of a support stand for the umbrella.

7. The device of claim 3, wherein the substantially T-shaped configuration includes: PVC pipes.

8. The device of claim 1, further comprising:

at least one member for insulating food or beverage items inside of the bucket.

9. A method of converting buckets from being used to carry items to being support anchors for umbrellas, comprising the steps of:

carrying a bucket containing at least one loose item from one location to another;

attaching an umbrella to a portion within the bucket;

positioning the bucket on a ground surface so that the bucket functions as an above ground anchor to support the umbrella in an upright position; and positioning a substantially T-shaped support member inside of the bucket by engaging arm members against inner side walls of the bucket and engaging a leg member against an inner bottom surface of the bucket.

10. The method of claim 9, wherein the step of carrying includes the step of:

rotating a handle on the bucket to a raised position above the bucket.

11. The method of claim 9, wherein the attaching step includes the step of:

telescopingly attaching a portion of an umbrella stand to the portion within the bucket.

12. The method of claim 9, further comprising the step of:

removing a lid from the bucket prior to attaching the umbrella to the bucket.

13. The method of claim 9, wherein the attaching step includes the step of:

threadably attaching a portion of an umbrella stand to the portion within the bucket.

14. The method of claim 9, further comprising:

insulating food or beverage items stored inside of the bucket to maintain temperatures of the stored items.

15. A device for both carrying supplies and being used as a support stand, comprising:

a bucket having a bottom floor portion, being positioned above a ground surface, and an upper opening;

a support member having a substantially T-shaped configuration having upper arm members adjacent to the upper opening of the bucket for engaging inner side walls of the bucket and having a vertical leg member extending downward from the upper arm members, the vertical leg member connected to an inside bottom floor portion of the bucket; and an umbrella attached to the support member, wherein the bucket supports the umbrella in an upright position, wherein the bucket carries items therein with or without the attached umbrella.

16. The device of claim 15, further comprising:

a portion for threadably connecting the vertical leg member to the inside bottom floor portion of the bucket.

17. The device of claim 15, further comprising:

a three prong connector, with each prong perpendicular to one another, for connecting the upper arm members and the vertical leg members together to form the substantially T-shaped configuration.

18. The device of claim 17, wherein the three prong connector includes an upper surface portion for telescoping connecting to a portion of a support stand for the umbrella.

19. The device of claim 15, wherein the substantially T-shaped configuration includes: PVC pipes.

* * * * *